US007341016B2

(12) United States Patent
Terleski et al.

(10) Patent No.: US 7,341,016 B2
(45) Date of Patent: Mar. 11, 2008

(54) FOLDING WATERCRAFT PLATFORM

(75) Inventors: Timothy W. Terleski, Garland, TX (US); Staci A. Mininger, Dallas, TX (US); Mark Megarity, Raleigh, NC (US); Scott L. Relyea, Richardson, TX (US)

(73) Assignee: TXS Industrial Design, Inc., Richardson, TX (US)

( * ) Notice: Subject to any disclaimer, the term of this patent is extended or adjusted under 35 U.S.C. 154(b) by 0 days.

(21) Appl. No.: 11/351,273

(22) Filed: Feb. 8, 2006

(65) Prior Publication Data

US 2006/0191464 A1 Aug. 31, 2006

Related U.S. Application Data

(60) Provisional application No. 60/651,359, filed on Feb. 8, 2005.

(51) Int. Cl.
*B63B 17/00* (2006.01)

(52) U.S. Cl. ..... 114/343; 114/362

(58) Field of Classification Search ..... 114/343, 114/364, 259, 362, 365; 182/84, 127, 222
See application file for complete search history.

(56) References Cited

U.S. PATENT DOCUMENTS

D286,716 S * 11/1986 Holbrook ..... D6/496
5,025,747 A * 6/1991 Grayson ..... 114/362
6,327,992 B1 * 12/2001 Martin ..... 114/259

* cited by examiner

*Primary Examiner*—Ed Swinehart

(57) ABSTRACT

A folding platform for mounting to an outer surface of a watercraft includes a platform, a hinge base attached to the outer surface of the watercraft, and a hinge arm pivotally coupled to both the hinge base and the platform. The hinge arm operates to position the platform in a deployed position and a stowed position. A top side of the platform in the deployed position faces away from the outer surface of the watercraft in the stowed position. Where the outer surface of the watercraft is curved, one of a plurality of hinge bases may be pivotally attached to the surface, such that a corresponding plurality of hinge arms move in substantially parallel planes. The hinge arm may be adjustably coupled to the platform such that the position of the hinge arm is capable of being adjusted along the axis of rotation of the pivotal coupling of the hinge arm to the platform.

20 Claims, 9 Drawing Sheets

FOLDING WATERCRAFT PLATFORM

CROSS-REFERENCE TO RELATED APPLICATIONS

This application claims priority under 35 U.S.C. § 119(e) to U.S. Provisional Application No. 60/651,359, filed on Feb. 8, 2005, which is hereby incorporated by reference.

TECHNICAL FIELD OF THE INVENTION

The present invention is directed, in general, to external platforms used on watercraft and, more specifically, to folding watercraft platforms.

BACKGROUND OF THE INVENTION

Many recreational boats have a platform to facilitate access to the water for swimmers, divers or equipment. Such platforms may be mounted to the side of the boat. Other such platforms mount to the transom of the boat near the water level and are typically referred to as swim (or dive) platforms.

Swim platforms may be formed as an integral part of a boat hull, as shown in U.S. Design Pat. No. 284,183. Swim platforms may also be permanently mounted to the transom of a boat, as shown in U.S. Pat. No. 4,669,414. Such permanently mounted platforms may attach to the transom with a hinged mounting to allow adjustment of the platform to a horizontal position, as shown in U.S. Pat. No. 3,613,137. However, such platforms add to the length of the boat, requiring additional storage space.

Swim platforms may also be mounted to a boat hull in such a way that they can be removed. U.S. Pat. No. 4,854,534 shows such a mounting. This type of mounting avoids permanently extending the length of the boat, however, the stability of the platform may degrade over time as a result of wear in the mounting mechanism. Attachment and removal of the platform, and stresses resulting from its use, may cause 'play' to develop between the pieces of the mechanism, with the consequence that the platform moves relative to the boat during use. Furthermore, the detached swim platform must be separately stored and secured for transportation.

Hinged mounting mechanisms for swim platforms have also been developed. One such mechanism is shown in U.S. Pat. No. 5,915,328, which describes a panel in a side gunwale of a boat, hinged just above the water line along its bottom edge, that folds out from the boat to form a platform. Other mechanisms are known in which a swim platform is mounted to the transom of a boat with hinges in such a way that the platform stows by folding upward against the transom. When stowed, the upper surface of such a prior art platform faces the transom of the boat and the platform support hardware extends outward from the stowed platform. Where the transom of the boat is curved, custom designed blocks must be used to mount the hinges of such a prior art platform so that a single, horizontal axis is formed for the platform to rotate about when being deployed or stowed.

There is, therefore, a need in the art for an improved folding swim platform.

SUMMARY OF THE INVENTION

Aspects of the invention may be found in a folding platform for mounting to an outer surface of a watercraft, including a platform, a hinge base attached to the outer surface of the watercraft, and a hinge arm pivotally coupled to the hinge base and pivotally coupled to the platform. The hinge arm operates to position the platform in a deployed position and a stowed position. A top side of the platform in the deployed position faces away from the outer surface of the watercraft in the stowed position.

Other aspects of the invention may be found in a watercraft including a platform, a hinge base attached to an outer surface of the watercraft, and a hinge arm pivotally coupled to the hinge base and pivotally coupled to the platform. The hinge operates to position the platform in a deployed position and a stowed position. A top side of the platform in the deployed position faces away from the outer surface of the watercraft in the stowed position.

Additional aspects of the invention may be found in a folding platform for mounting to a curved outer surface of a watercraft. The folding platform includes a plurality of hinge bases coupled to the outer surface of the watercraft. The folding platform also includes a corresponding plurality of hinge arms. Each of the plurality of hinge arms is pivotally coupled to a corresponding one of the plurality of hinge bases and pivotally coupled to the platform. The plurality of hinge arms are capable of positioning the platform in a deployed position that is substantially perpendicular to the outer surface of the watercraft and in a stowed position that is substantially parallel to the outer surface of the watercraft. At least one hinge base is pivotally coupled to the outer surface of the watercraft. The hinge arms are capable of moving in substantially parallel planes. An axis of rotation of the platform is substantially perpendicular to a plane of motion of at least one of the plurality of hinge arms.

Other aspects of the invention may be found in a folding platform for mounting to an outer surface of a watercraft. The folding platform includes a platform and a hinge base attached to the outer surface of the watercraft. The folding platform also includes a hinge having a proximal end and a distal end. The hinge arm is pivotally coupled at its proximal end to the hinge base. The hinge arm is pivotally coupled at its distal end to the platform. The hinge arm is capable of positioning the platform in a deployed position and a stowed position. A top side of the platform in the deployed position faces away from the outer surface of the watercraft in the stowed position.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art will appreciate that they may readily use the conception and the specific embodiment disclosed as a basis for modifying or designing other structures for carrying out the same purposes of the present invention. Those skilled in the art will also realize that such equivalent constructions do not depart from the spirit and scope of the invention in its broadest form.

BRIEF DESCRIPTION OF THE DRAWINGS

For a more complete understanding of the present invention, and the advantages thereof, reference is now made to the following descriptions taken in conjunction with the accompanying drawings, wherein like numbers designate like objects, and in which.

DETAILED DESCRIPTION OF EXAMPLE EMBODIMENTS

FIGS. 1 through 8, discussed below, and the various embodiments used to describe the principles of the present invention in this patent document are by way of illustration only and should not be construed in any way to limit the scope of the invention. Those skilled in the art will understand that the principles of the present invention may be implemented in any suitably arranged device. The numerous innovative teachings of the present application will be described with particular reference to the example embodiments.

An embodiment of the present invention is described in which a platform mounts to the outer surface of a boat by means of an articulated hinge mechanism. In a deployed position, pins may be fitted into the hinge mechanism to hold the platform stably in a substantially horizontal position. When so deployed, persons on the boat may stand on, or rest equipment on, a top side of the platform in order to facilitate passage between the boat and the water of persons and equipment.

The pins may be removed and the platform repositioned to a stowed position by operation of the articulated hinge mechanism. The pins may then be reinserted into the hinge mechanism to hold the platform securely in the stowed position. In the stowed position, the platform may lie substantially parallel to and adjacent to the outer surface of the boat, with the top side of the platform facing away from the boat and the articulated hinge mechanism lying between the platform and the boat. In this position, the hinge mechanism may be substantially hidden by the platform, and any graphical designs or decorations applied to the top side of the platform may be presented to a person viewing the exterior of the boat.

Figure 1:
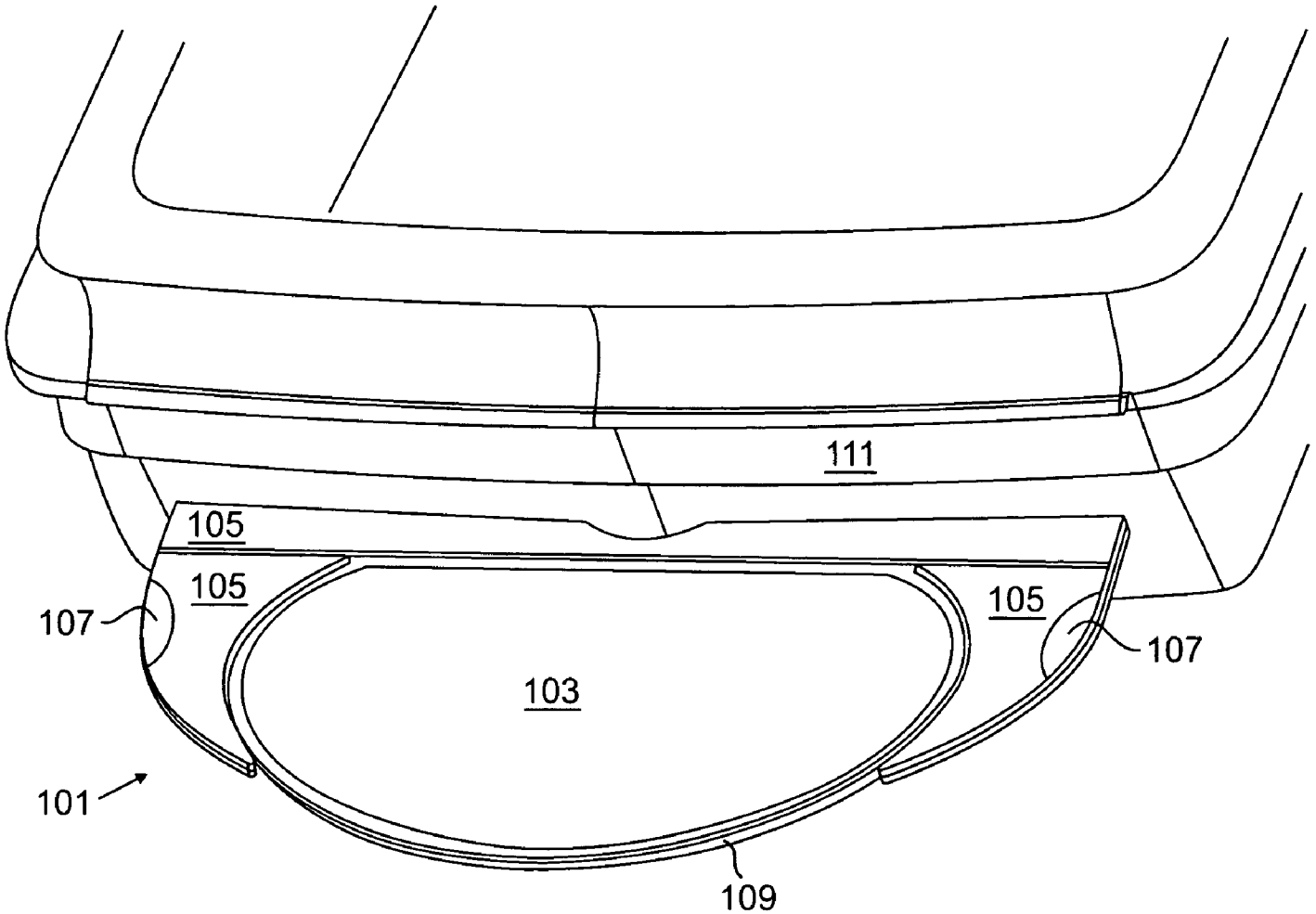
FIG. 1 depicts an orthogonal view, from above, of an illustrative embodiment of the present invention, mounted on the transom of a boat, in a deployed position.

FIG. 1 presents an orthogonal view from above of a folding swim platform 101 according to the present invention. A top side of a platform 109 may include a central portion 103 and peripheral portions 105. The platform 109 may be mounted to an outer surface 111 of a watercraft by a hinge mechanism (not shown in FIG. 1). The peripheral portion 105 of the platform 109 positioned adjacent to the outer surface 111 may be curved to match a curvature of the outer surface 111. While in this embodiment of the invention the platform is shown mounted to the transom of a boat, it will be understood that the platform could be mounted to any outer surface of a boat without departing from the scope of the present invention.

Figure 2:
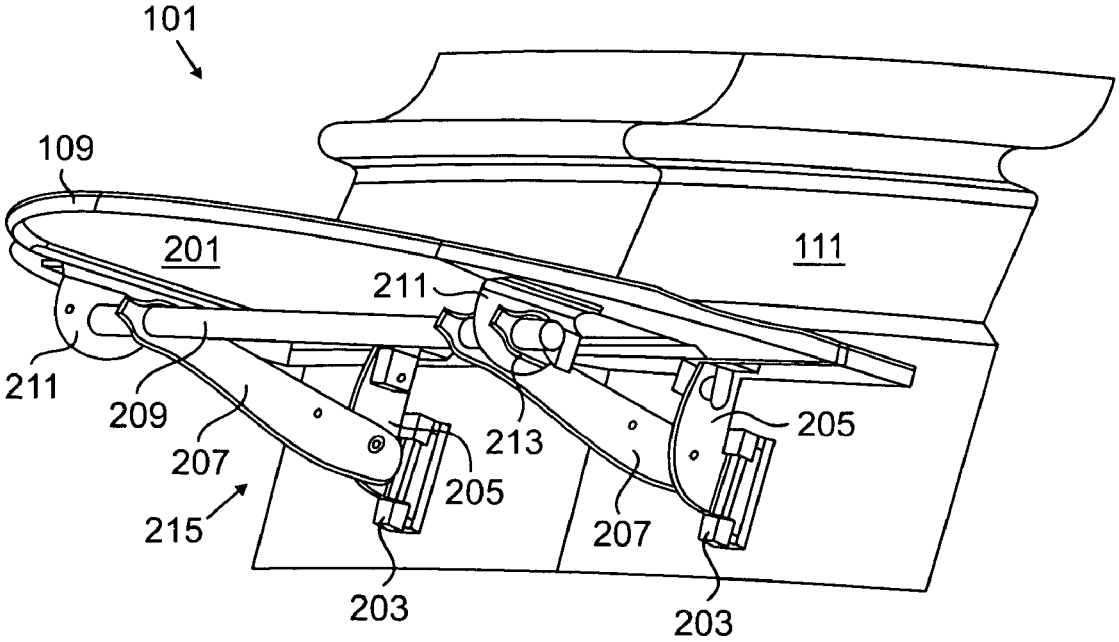
FIG. 2 shows an orthogonal view from below of the embodiment of the invention shown in FIG. 1.

An embodiment of an articulated hinge mechanism 215 according to the present invention is shown in FIG. 2, which presents an orthogonal view from below of folding swim platform 101 of FIG. 1. Hinge anchors 203 may be mounted to the outer surface 111 of the boat. Hinge bases 205 may be pivotally mounted to the hinge anchors 203, such that the hinge bases 205 pivot about a substantially vertical axis. Hinge arms 207 may be pivotally attached at a proximal end to the hinge bases 205 such that the hinge arms 207 pivot about a substantially horizontal axis. At a distal end, the hinge arms 207 may be fixedly attached to an axle 209. Axle anchors 213 (only one of which may be seen in FIG. 2) may also be fixedly mounted to the axle 209. Platform bases 211 may be fitted around the axle 209, such that the platform bases 211 are capable of rotation about the axle 209. The platform bases 211 are mounted to a bottom side 201 of the platform 109.

The hinge bases 205, the hinge arms 207, the axle 209, the axle anchors 213, and the platform bases 211 cooperate to form the articulated hinge mechanism 215. The operation of the articulated hinge 215 is illustrated in subsequent figures of the drawing. As shown in FIG. 2, the left and right components of hinge mechanism 215 may be arranged in a mirror image of each other. It will be understood that an articulated hinge according to the present invention may be formed from a single set of components or from three or more sets of components. It also will be understood that an articulated hinge according to the present invention may be formed from a single set of components either centrally mounted to the platform 109 or mounted to one side, with the platform 109 cantilevered from the articulated hinge mechanism 215.

Figure 3:
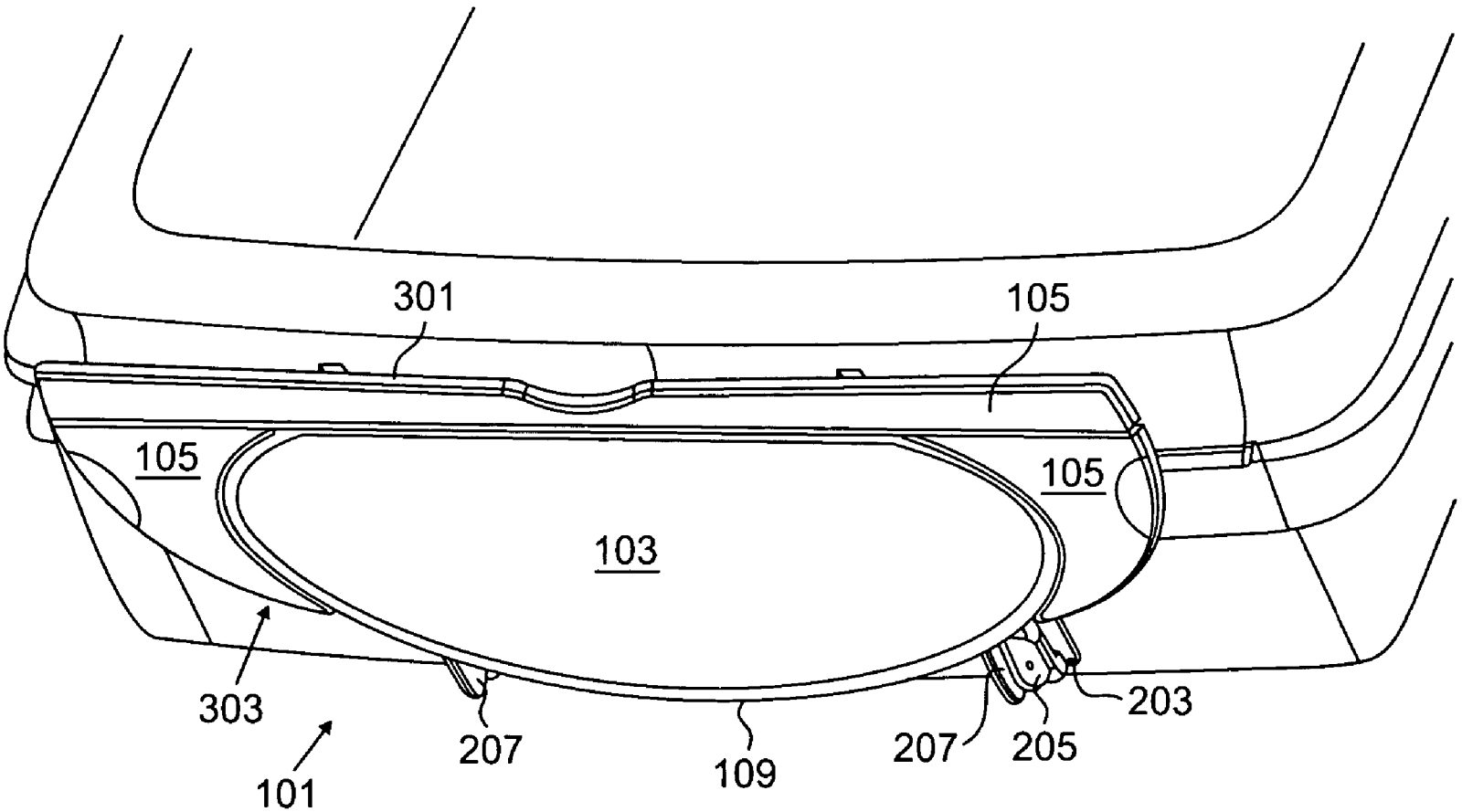
FIG. 3 illustrates the embodiment of FIG. 1 in a stowed position, in an orthogonal view from above.

FIG. 3 shows the folding swim platform 101 in a stowed position substantially parallel to and adjacent to the outer surface 111 of the boat. The top side of the platform 109 in the deployed position illustrated in FIG. 1 faces away from the boat in the stowed position illustrated in FIG. 3. The central portion 103 and the peripheral portions 105 of the top side of the platform 109 may be seen in the stowed position. The articulated hinge mechanism 215 may lie between the platform 109 and the outer surface 111. Furthermore, the articulated hinge mechanism 215 may be substantially hidden by the platform 109, with only portions of the hinge anchors 203, the hinge bases 205, and the hinge arms 207 visible in FIG. 3. An edge 301 of platform 109, which was adjacent to the outer surface 111 of the boat when the platform 109 was in the deployed position shown in FIG. 1, forms a top edge of the platform 109 in the stowed position shown in FIG. 3. Similarly, an edge 303 of the platform 109 (not visible in FIG. 3), which was an edge farthest from the outer surface 111 of the boat in the deployed position, forms a bottom edge of the platform 109 in the stowed position.

In another embodiment of the present invention, the central portion 103 and/or the peripheral portions 105 of the platform 109 may display a graphic design, company logo, or other decorative element. Such a visual element may be fabricated into the surface of the platform 109 or may be applied after the platform is manufactured. Portions of the upper surface of the platform 109 (for example, the central portion 103) may be recessed or textured or otherwise fabricated to facilitate the application and retention of such an applied visual element. The decoration chosen may represent the manufacturer of the watercraft, the swim platform or other related equipment. Alternatively, the decoration may be chosen by the boat owner to represent a club affiliation, support for an athletic team, or for purely aesthetic reasons. Because the top side of the platform 109 in the deployed position illustrated in FIG. 1 faces away from the boat in the stowed position illustrated in FIG. 3, the decoration will be visible in either the deployed or stowed positions of the platform 109.

In yet another embodiment of the present invention, the central portion 103 and/or the peripheral portions 105 of the platform 109 may be fabricated with a non-slip surface chosen to provide traction while the platform 109 is in the deployed position shown in FIG. 1. Such traction may be provided by a texture formed into the surface of the platform 109 or from material applied to the surface after manufacture.

Figure 4:
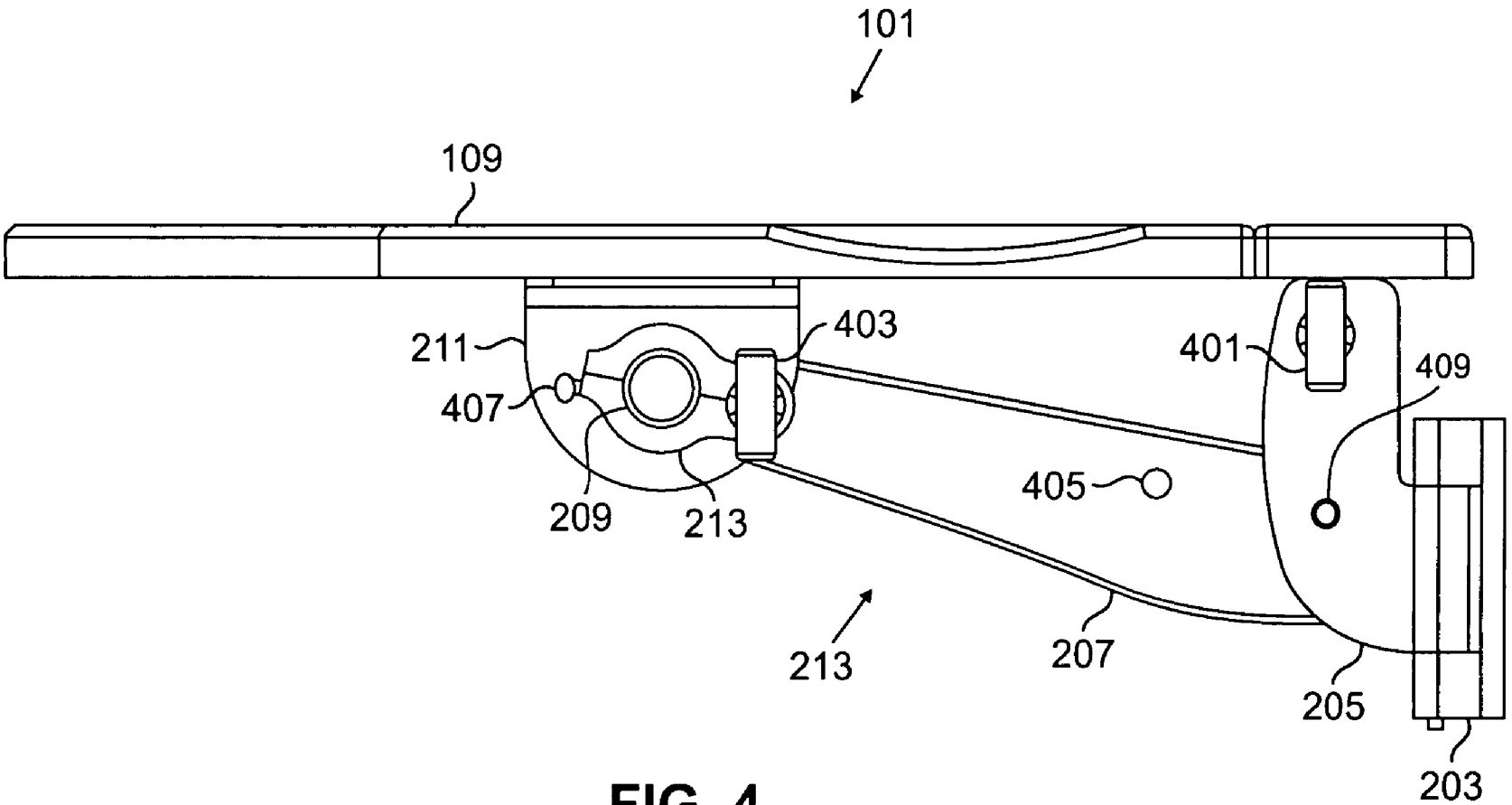
FIG. 4 depicts an illustrative embodiment of a hinge mechanism of the present invention in a deployed position, viewed from the side.
Figure 5:
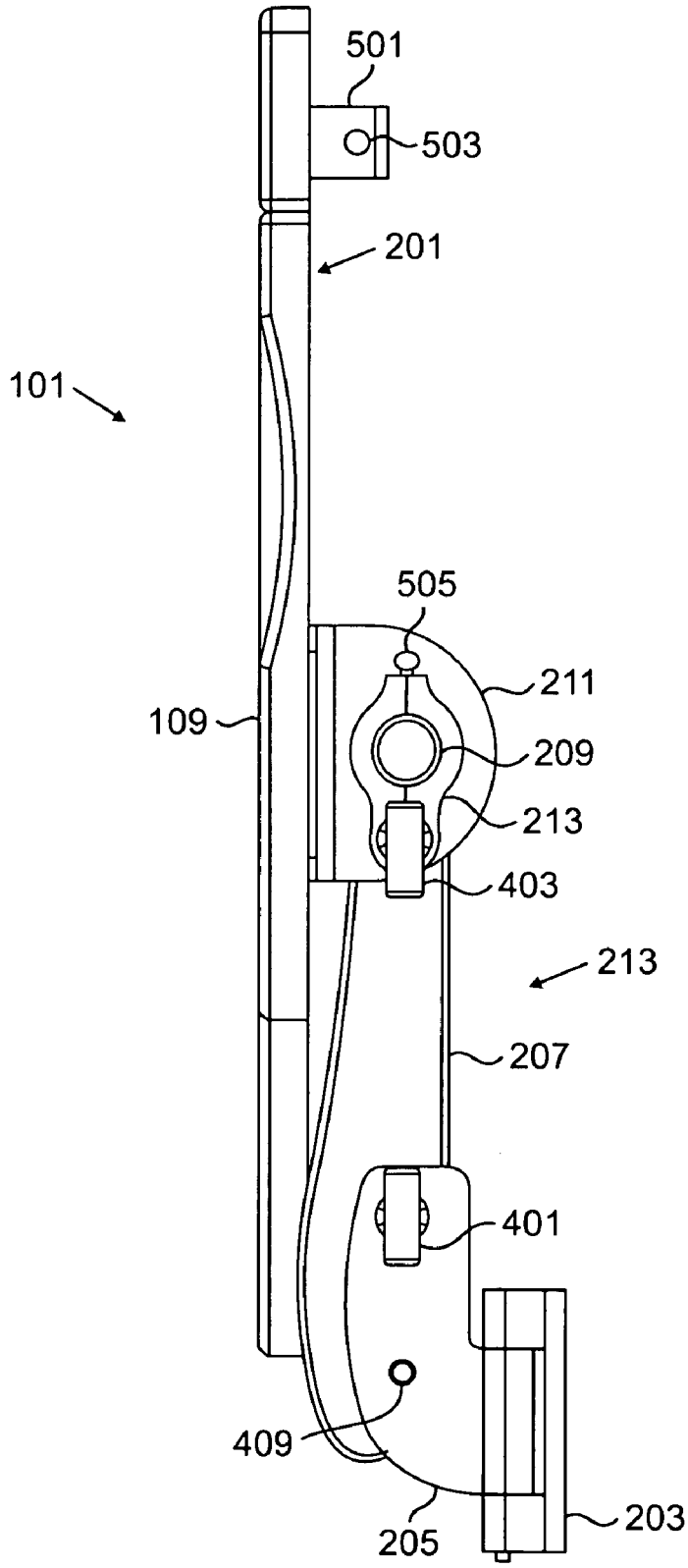
FIG. 5 illustrates the hinge mechanism of FIG. 4 in a stowed position, viewed from the side.

The articulated hinge mechanism 215 of the embodiment of the present invention shown in FIG. 2 is illustrated in greater detail in FIGS. 4 and 5, which will be described together. FIG. 4 shows a side view of the hinge mechanism 215 in the deployed position depicted in FIG. 1. FIG. 5 shows a side view of the hinge mechanism 215 in the stowed position depicted in FIG. 3. FIGS. 4 and 5 show the articulated hinge 215 from the right side, as viewed in FIG. 2. As such, FIGS. 4 and 5 show only one of the two sets of hinge components of the embodiment of the hinge mechanism 215 illustrated in FIG. 2. It will be understood that matching elements to those described in FIGS. 4 and 5 may be found in the other of the two sets of hinge components.

Pins 401 and 403 may be captured in the hinge base 205 and the axle anchor 213, respectively, and couple with other elements of the folding swim platform 101 to hold the platform 109 securely in its deployed and stowed positions. The pins 401 and 403 may be deformable to ease retraction and insertion and spring-loaded to return to a default shape to ensure their secure retention when engaged with other elements of the articulated hinge mechanism 215. Referring to FIG. 5, a platform anchor 501 having a hole 503 may be attached to the bottom side 201 of the platform 109. In the deployed position depicted in FIG. 4, the pin 401 may engage the hole 503 in the platform anchor 501 in order to secure the platform 109 to the hinge base 205. In the embodiment of the invention depicted in FIG. 4, the pin 403 is retracted and does not engage the platform base 211.

In the stowed position illustrated in FIG. 5, the pin 401 has been retracted from the hole 503 of the platform anchor 501, the platform 109 has been repositioned to its stowed position and the pins 401 and 403 have been inserted to secure the folding swim platform 101 in its stowed position. The pin 401 engages a hole 405 (not visible in FIG. 5) in the hinge arm 207 to prevent rotation of the hinge arm 207 relative to the hinge base 205. The pin 403 engages a hole 407 (not visible in FIG. 5) in the platform base 211 to prevent rotation of the platform 109 relative to the axle 209.

The repositioning of the platform 109 from its deployed position to its stowed position may be described with reference to FIGS. 4, 5 and 8A. When the pin 401 is disengaged from the platform anchor 501, the platform 109 and the platform base 211 may be rotated about the axle 209 from the position shown in FIG. 4 to the position shown in FIG. 8A. The pin 403 may then engage the hole 407 of the platform base 211 to prevent further rotation of the platform 109 about the axle 209. The hinge arm 207 may then be rotated about a pivot 409 from the substantially horizontal position shown in FIG. 4 to the substantially vertical position shown in FIG. 5. The pin 401 may then engage the hole 405 in the hinge arm 207 to prevent further rotation of the hinge arm 207 relative to the hinge base 205.

Figure 6A:
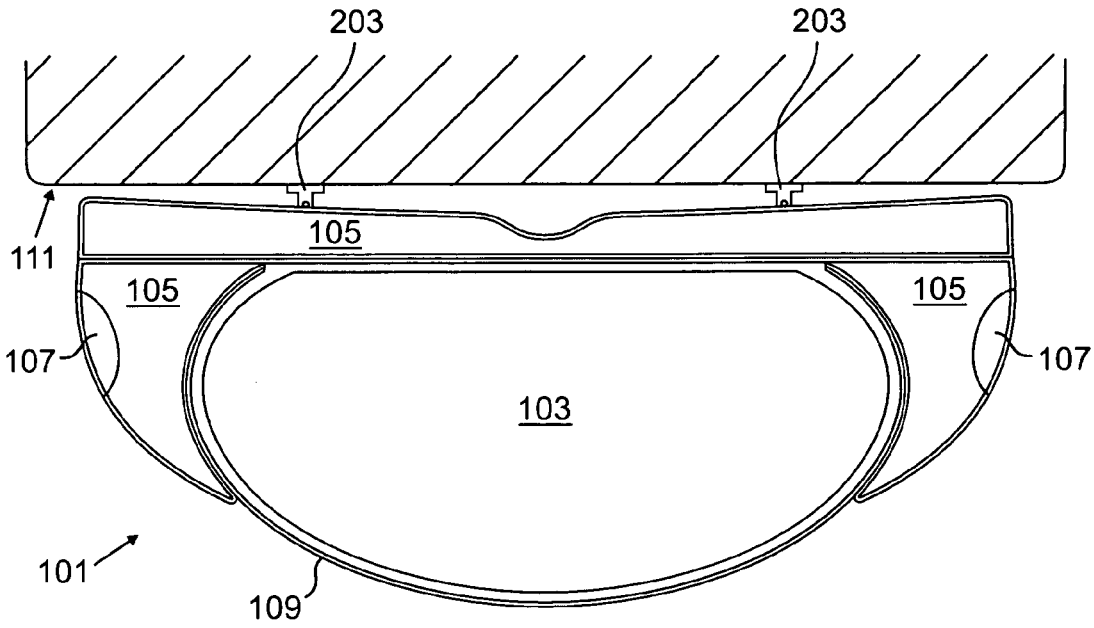
FIGS. 6A, 6B and 6C show top, back and bottom views, respectively, of an illustrative embodiment of the present invention mounted on the transom of a boat, in a deployed position.
Figure 6B:
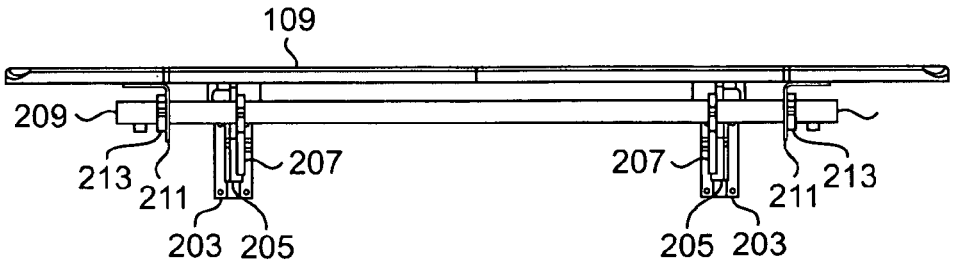
Figure 6C:
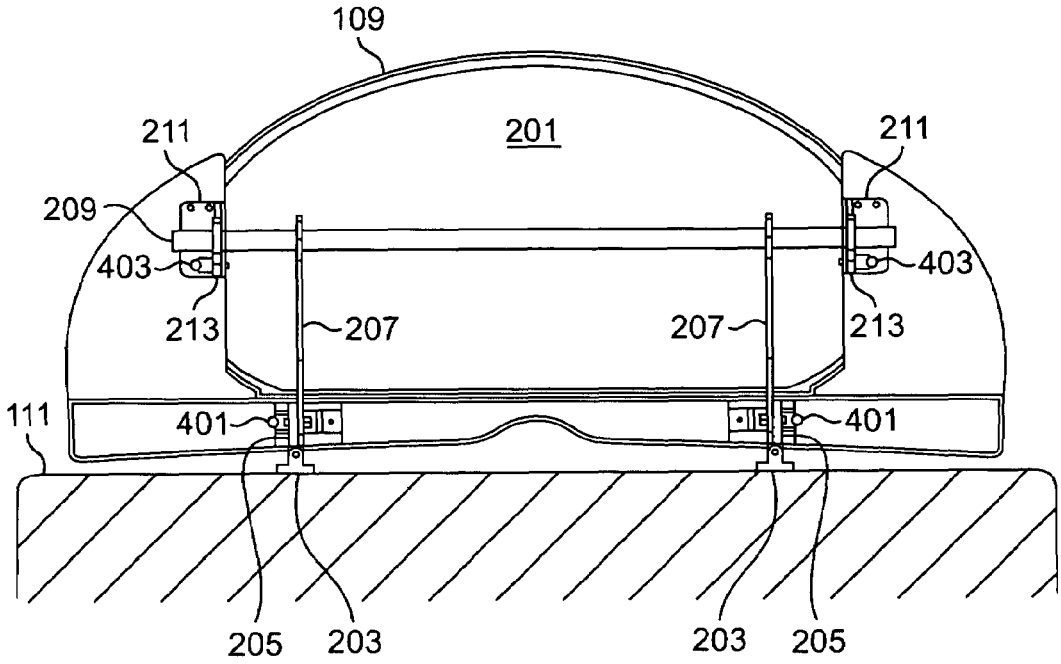
Figure 7A:
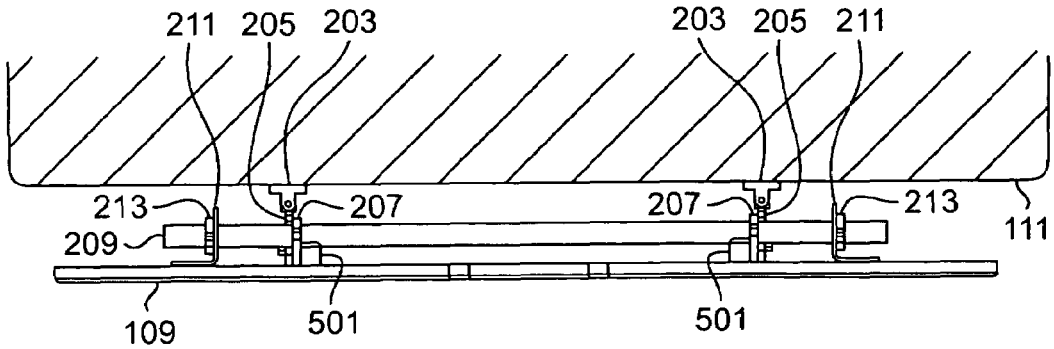
FIGS. 7A, 7B and 7C depict top, back and bottom views, respectively, of an illustrative embodiment of the present invention mounted on the transom of a boat, in a stowed position.
Figure 7B:
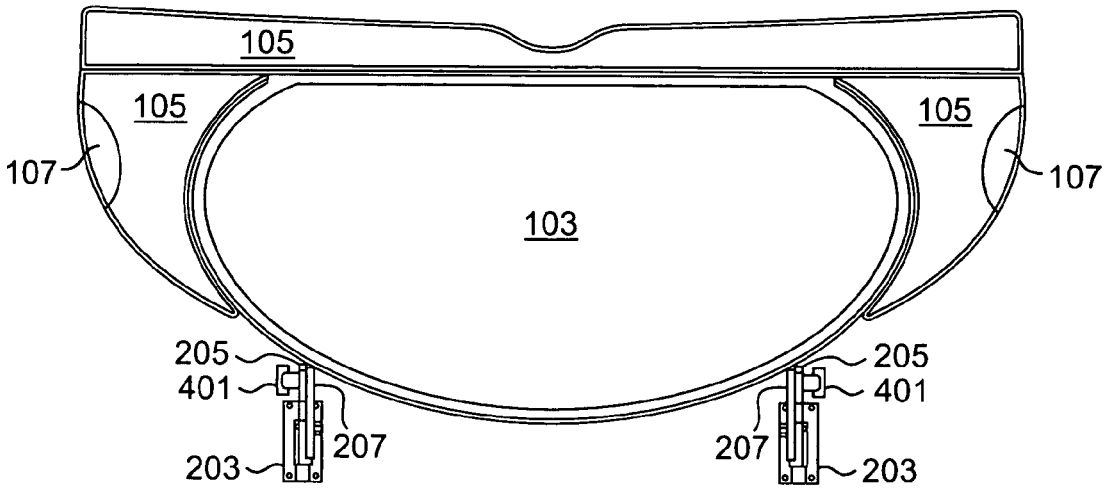
Figure 7C:
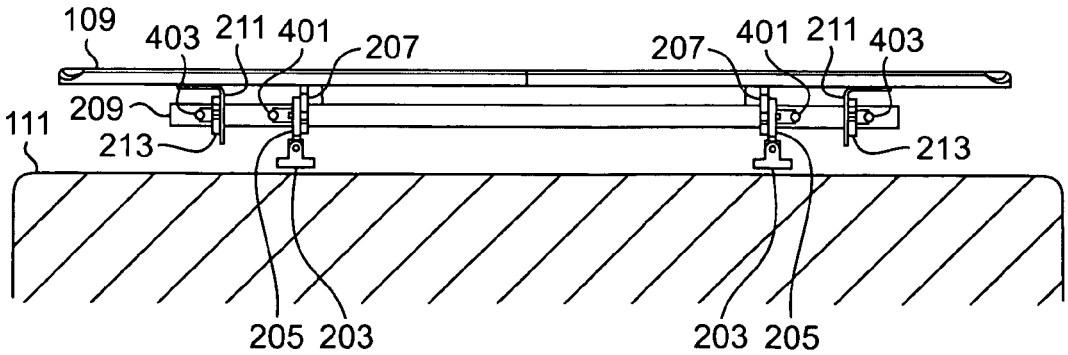

FIGS. 6A, 6B and 6C depict top, front and bottom views, respectively, of the folding swim platform 101 according to the present invention in its deployed position. FIGS. 7A, 7B and 7C show top, front and bottom views, respectively, of the folding swim platform 101 according to the present invention in its stowed position.

Figures 8A, 8B:
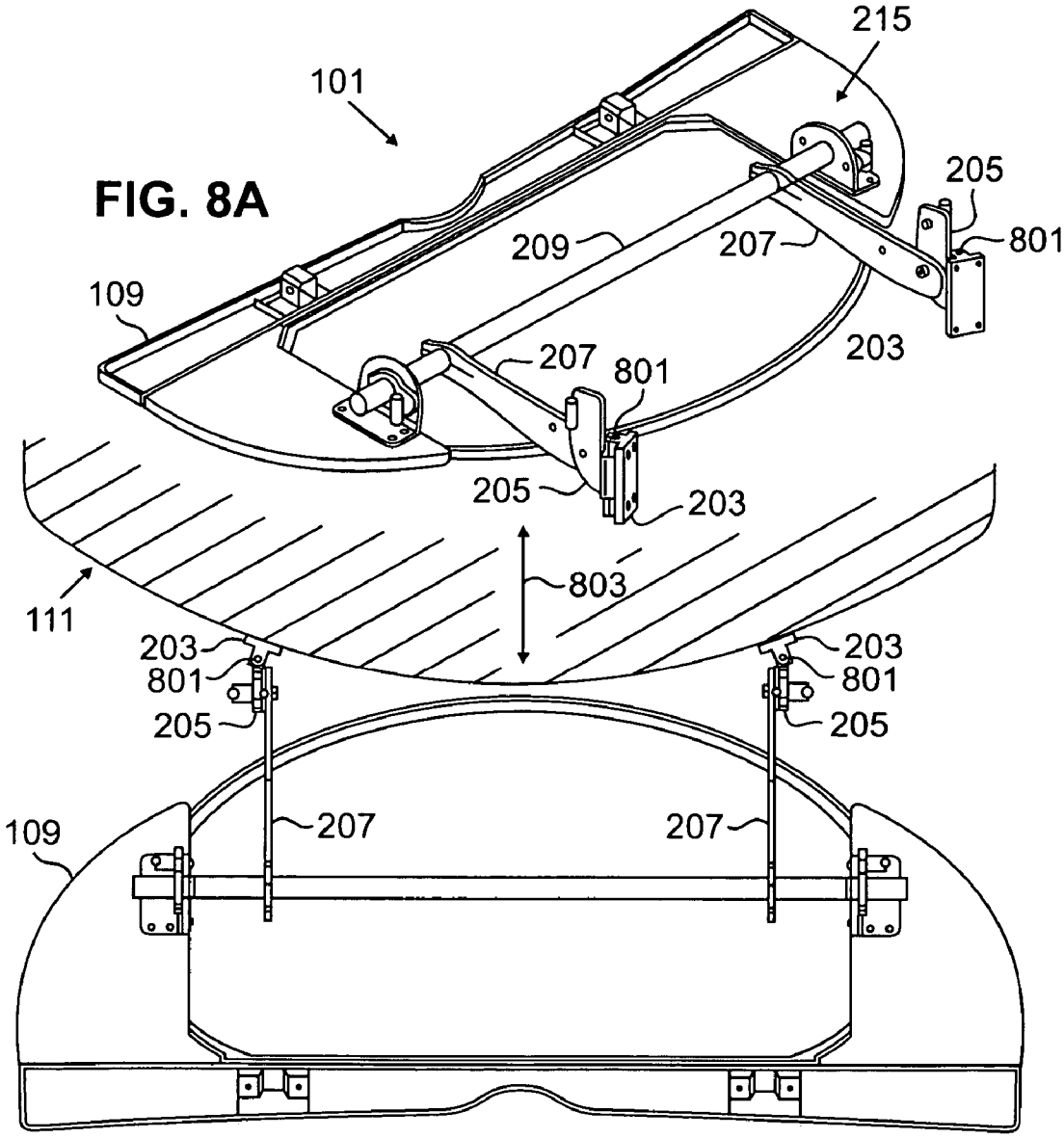
FIG. 8A shows an orthogonal view, from above, of an illustrative embodiment of the present invention in an intermediate position between a deployed position and a stowed position.
FIG. 8B shows a top view of the embodiment of FIG. 8A, in the same intermediate position.

FIGS. 8A and 8B present orthogonal and top views, respectively, of the folding swim platform 101 in an intermediate position between its deployed and stowed positions. The platform 109 has been rotated about the axle 209 so that the platform 109 now hangs below the articulated hinge mechanism 215. Also illustrated in FIGS. 8A and 8B is the capability of the hinge bases 205 to rotate about pivots 801 relative to their corresponding hinge anchors 203. Where the outer surface 111 of the watercraft is curved, as shown in FIG. 8B, the hinge bases 205 may be pivoted on a substantially vertical axis relative to their corresponding hinge anchors 203 in order to align the hinge arms 207 substantially parallel to each other or to a longitudinal axis 803 of the boat.

Watercraft made by different manufacturers may have outer surfaces with different degrees of curvature, but generally shaped as shown in FIG. 8B. The articulated hinge mechanism 215 such as that illustrated in FIGS. 8A and 8B may thus be adapted to whatever degree of curvature is exhibited by the watercraft to which the folding swim platform 101 is attached. It will be understood, however, that in another embodiment of the present invention, the hinge bases 205 may be fixedly attached to the hinge anchors 203 at a preset angle chosen to adapt the articulated hinge mechanism to the curvature (or lack of curvature) of the outer surface of a particular watercraft.

Another aspect of the articulated hinge mechanism 215 according to the present invention is illustrated in FIGS. 8A and 8B. As described with reference to FIG. 2, the distal ends of the hinge arms 207 may be fixedly attached to the axle 209. In the embodiment of the present invention shown in FIG. 8A, this attachment is formed by a clamp mechanism fabricated into the hinge arms 207, which allow the hinge arms 207 to clamp onto the axle 209. Loosening the clamps permits the hinge arms 207 to be re-positioned horizontally along the axle 209. The clamps may be retightened when a desired horizontal spacing has been obtained between the hinge arms 207 and their corresponding hinge anchors 203. This permits the hinge anchors 203 to be positioned at a desired location on the outer surface 111 of the watercraft, in order to attach to existing mounting points on the watercraft or to internal structural members under the surface of the watercraft. In this way, the folding swim platform 101 may be securely mounted to the watercraft, in order to provide a more stable platform in use.

The platform 109 of the illustrative embodiment of the present invention depicted in these figures is shown as a molded product, fabricated from fiberglass or rotationally molded plastic, for example. It will be understood, however, that in another embodiment of the present invention the platform 109 might alternatively be made of other materials, such as wood, or of a combination of materials.

While the present invention has been described in detail with respect to certain embodiments thereof, those skilled in the art should understand that various changes, substitutions, modifications, alterations, and adaptations in the present invention may be made without departing from the concept and scope of the invention in its broadest form.

What is claimed is:

1. A folding platform for mounting to an outer surface of a watercraft, comprising:

a platform;

a hinge base, attached to the outer surface of the watercraft; and a hinge arm pivotally coupled to the hinge base and pivotally coupled to the platform, wherein the hinge arm is capable of positioning the platform in a deployed position substantially perpendicular to the outer surface of the watercraft and a stowed position substantially parallel to the outer surface of the watercraft, such that a top side of the platform in the deployed position faces away from the outer surface of the watercraft in the stowed position.

2. The folding platform of claim 1, wherein the outer surface of the watercraft is curved, further comprising a plurality of hinge anchors, wherein:

the hinge base comprises a plurality of hinge bases corresponding to the plurality of hinge anchors;

the hinge arm comprises a plurality of hinge arms corresponding to the plurality of hinge bases; and at least one of the hinge bases is pivotally coupled to its corresponding hinge anchor, such that the plurality of hinge arms are capable of moving in substantially parallel planes of motion.

3. The folding platform of claim 1, wherein the top side of the platform in the deployed position comprises a non-slip surface.

4. The folding platform of claim 1, wherein the top side of the platform in the deployed position comprises a decoration.

5. The folding platform of claim 1, wherein the top side of the platform in the deployed position is adapted to receive a decoration.

6. The folding platform of claim 1, wherein the hinge arm is adjustably coupled to the platform such that a position of the hinge arm is capable of being adjusted along an axis of rotation of the pivotal coupling of the hinge arm to the platform.

7. The folding platform of claim 6, wherein the adjustable coupling of the hinge arm to the platform comprises a substantially linear member coupled to the platform, and wherein the hinge arm is coupled to the member such that the hinge arm is capable of sliding along a length of the member.

8. The folding platform of claim 1, wherein the coupling of the hinge arm to the platform comprises a pin, such that when the pin is inserted the hinge arm is prevented from operating to reposition the platform.

9. A watercraft, comprising:

an outer surface;

a platform;

a hinge base, attached to the outer surface of the watercraft; and a hinge arm pivotally coupled to the hinge base and pivotally coupled to the platform, wherein the hinge arm is capable of positioning the platform in a deployed position substantially perpendicular to the outer surface of the watercraft and a stowed position substantially parallel to the outer surface of the watercraft, such that a top side of the platform in the deployed position faces away from the outer surface of the watercraft in the stowed position.

10. The watercraft of claim 9, wherein the outer surface of the watercraft is curved, further comprising a plurality of hinge anchors, wherein:

the hinge base comprises a plurality of hinge bases corresponding to the plurality of hinge anchors;

the hinge arm comprises a plurality of hinge arms corresponding to the plurality of hinge bases; and at least one of the hinge bases is pivotally coupled to its corresponding hinge anchor, such that the plurality of hinge arms are capable of moving in substantially parallel planes of motion.

11. The watercraft of claim 9, wherein the top side of the platform in the deployed position comprises a non-slip surface.

12. The watercraft of claim 9, wherein the top side of the platform in the deployed position comprises a decoration.

13. The watercraft of claim 9, wherein the top side of the platform in the deployed position is adapted to receive a decoration.

14. The watercraft of claim 9, wherein the hinge arm is adjustably coupled to the platform such that a position of the hinge arm is capable of being adjusted along an axis of rotation of the pivotal coupling of the hinge arm to the platform.

15. The watercraft of claim 14, wherein the adjustable coupling of the hinge arm to the platform comprises a substantially linear member coupled to the platform, and wherein the hinge arm is coupled to the member such that the hinge arm is capable of sliding along a length of the member.

16. The watercraft of claim 9, wherein the coupling of the hinge arm to the platform comprises a pin, such that when the pin is inserted the hinge arm is prevented from operating to reposition the platform.

17. A folding platform for mounting to a curved outer surface of a watercraft, comprising:

a platform;

a plurality of hinge bases, coupled to the outer surface of the watercraft; and a plurality of hinge arms, each of the plurality of hinge arms pivotally coupled to a corresponding one of the plurality of hinge bases and pivotally coupled to the platform, wherein the plurality of hinge arms are capable of positioning the platform in a deployed position substantially perpendicular to the outer surface of the watercraft and a stowed position substantially parallel to the outer surface of the watercraft, wherein at least one of the hinge bases is pivotally coupled to the outer surface of the watercraft, such that the hinge arms are capable of moving in substantially parallel planes, and an axis of rotation of the platform is substantially perpendicular to a plane of motion of at least one of the plurality of hinge arms.

18. The folding platform of claim 17, wherein at least one of the plurality of hinge arms is adjustably coupled to the platform such that a position of the hinge arm is capable of being adjusted along the axis of rotation of the pivotal coupling of the hinge arm to the platform.

19. A folding platform for mounting to an outer surface of a watercraft, comprising:

a platform;

a hinge base, attached to the outer surface of the watercraft; and a hinge arm having a proximal end and a distal end, the hinge arm being pivotally coupled at its proximal end to the hinge base and pivotally coupled at its distal end to the platform, wherein the hinge arm is capable of positioning the platform in a deployed position substantially perpendicular to the outer surface of the watercraft and a stowed position substantially parallel to the outer surface of the watercraft, such that a top side of the platform in the deployed position faces away from the outer surface of the watercraft in the stowed position.

20. The folding platform of claim 19, wherein the hinge arm is adjustably coupled to the platform such that a position of the hinge arm is capable of being adjusted along an axis of rotation of the pivotal coupling of the hinge arm to the platform.

* * * * *